US007487703B2

(12) United States Patent
Lockhart et al.

(10) Patent No.: US 7,487,703 B2
(45) Date of Patent: Feb. 10, 2009

(54) DUAL HEADED PUNCH WITH TAPERED NECK

(75) Inventors: Anthony Lockhart, Shaker Heights, OH (US); John C. Collier, Jr., Solon, OH (US); Sonny Sneed, Akron, OH (US)

(73) Assignee: M.O.M. Tools, LLC, Shaker Heights, OH (US)

( * ) Notice: Subject to any disclaimer, the term of this patent is extended or adjusted under 35 U.S.C. 154(b) by 0 days.

(21) Appl. No.: 11/855,176

(22) Filed: Sep. 14, 2007

(65) Prior Publication Data

US 2008/0000338 A1 Jan. 3, 2008

Related U.S. Application Data

(63) Continuation of application No. 10/964,074, filed on Oct. 13, 2004, now abandoned.

(51) Int. Cl.
*B26F 1/14* (2006.01)

(52) U.S. Cl. ..... 83/688; 83/621

(58) Field of Classification Search ..... 83/688, 83/621, 686, 681, 666, 698.91, 667; 409/258, 409/259

See application file for complete search history.

(56) References Cited

U.S. PATENT DOCUMENTS

| | | | | |
|---|---|---|---|---|
| 295,227 | A * | 3/1884 | Briggs | 83/688 |
| 2,080,850 | A | 5/1937 | Frayer | |
| 2,522,440 | A * | 9/1950 | Freter | 72/464 |
| 4,762,043 | A * | 8/1988 | Sneed | 83/688 |
| 5,235,881 | A | 8/1993 | Sano et al. | |
| 2003/0183057 | A1 | 10/2003 | Birch et al. | |

OTHER PUBLICATIONS

International Search Report for PCT/US2005/35586 mailed Jun. 1, 2007, two pages.

* cited by examiner

*Primary Examiner*—Kenneth E. Peterson
*Assistant Examiner*—Sean Michalski
(74) *Attorney, Agent, or Firm*—Rankin, Hill & Clark LLP

(57) ABSTRACT

A tool is disclosed, for use with a punching press for punching holes in workpieces. A punch body is provided, elongated in an axial direction. A first punch head is formed on an end of the punch body, and has a first radial diameter, perpendicular to the axial direction. A second punch head has a second radial diameter, also perpendicular to the axial direction. The second punch head is substantially spaced from the first punch head. A neck is formed between the first and second punch heads, having a uniformly tapered diameter less than the first and second radial diameters.

1 Claim, 2 Drawing Sheets

DUAL HEADED PUNCH WITH TAPERED NECK

This application is a continuation of commonly owned U.S. Ser. No. 10/964,074, filed Oct. 13, 2004 now abandoned, the entire contents of which is hereby incorporated by reference.

BACKGROUND OF THE INVENTION

1. Field of the Invention

The present invention relates in general to the field of metal working punches for the cold working of metal. The invention has particular applicability as a dual-headed punch with an improved punching head suitable for increasing the life of the tool.

2. Description of the Prior Art

A punch is used in a machining operation for the cold working of metal. A typical punch has a punching head that engages the workpiece. The head is forced, in an axial direction, through the workpiece, thereby removing the metal in its path. Punching is useful for quickly forming a rough hole in a material, and can be a preliminary to a boring operation and/or a tapping operation.

Several problems are encountered in a typical punching operation. A punch typically creates a rough hole in a metal workpiece. Due to deformation of the metal that occurs during the punch operation, the hole may not be suitably large enough. This can result in extra boring time and wear on the boring tool during the subsequent operation. Further, the punched hole may be irregular in shape, or may have metal burrs that remain along the edges. These problems lead to scrap parts, or at best, they necessitate reworking of the parts.

Tool life is a critical issue, and there is always a need for a longer life tool, especially in long-run applications such as those commonly seen in the automotive and appliance fields. Sneed U.S. Pat. No. 4,762,043, which is incorporated herein by reference, concerns a long wearing punch having first and second punching edges.

Additionally, a punch works in cooperation with a die, which has a bore to receive the punch and the metal "button" or "slug" that is removed from the metal workpiece. However, a common problem is that the slug can get caught inside the bore of the die. It can be difficult to remove the slug from inside the die, and the problem can be further complicated when multiple slugs get hung up inside the die. This can result in machine maintenance while the die is serviced or changed, resulting in loss of production due to machine down-time.

SUMMARY OF THE INVENTION

The difficulties and drawbacks of previous punch press tools are overcome by the tool of the present invention, for use with a punching press for punching holes in workpieces. More particularly, the present invention provides a tool with improved useful life. A punch body is provided, elongated in an axial direction. A first punch head is formed on an end of the punch body, and has a first radial diameter, perpendicular to the axial direction. A second punch head has a second radial diameter, also perpendicular to the axial direction. The second punch head is substantially spaced from the first punch head. A neck is formed between the first and second punch heads, having a uniformly diameter less than the first and second radial diameters. The neck forms a single continuous surface between the first and second punch heads.

As will be realized, the invention is capable of other and different embodiments and its several details are capable of modifications in various respects, all without departing from the invention. Accordingly, the drawing and description are to be regarded as illustrative and not restrictive.

DETAILED DESCRIPTION OF THE PREFERRED EMBODIMENTS

Figure 1:
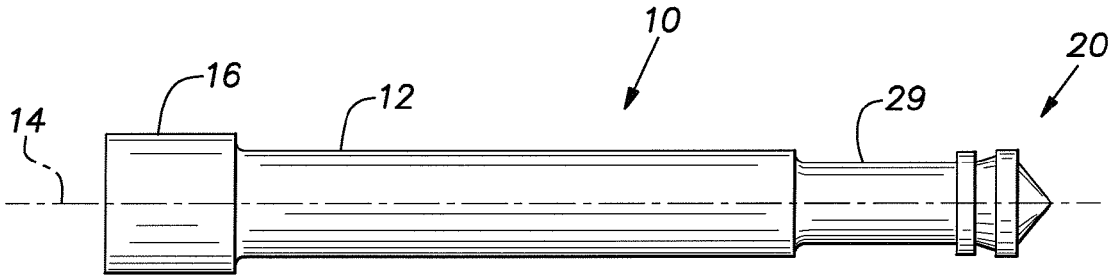
FIG. 1 shows a punch in accordance with the present invention.

The figures show tools for use in a punch press for punching holes in a metal workpiece, where it is understood that like reference numerals refer to like elements. FIG. 1 shows a punch 10 having a punch body 12, which is elongated in an axial direction, i.e. along a tool axis 14. The punch body 12 includes a chuck end 16 for being received in a punch press tool chuck.

Figure 2A:
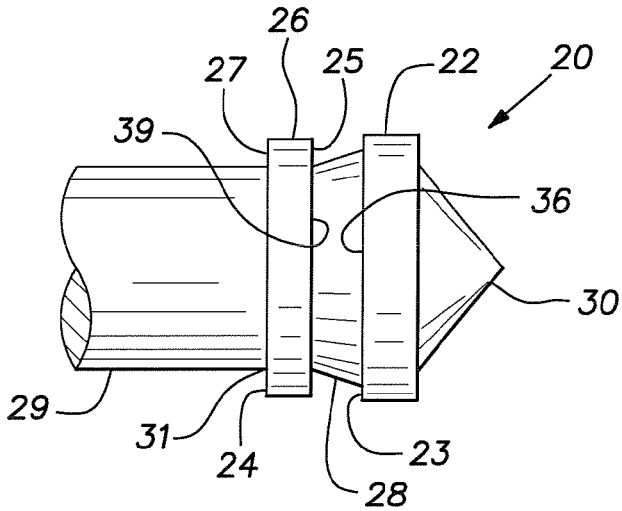
FIGS. 2A and 2B respectively show a detail of the punch head and a side-sectional view thereof, in accordance with the present invention.
Figure 2B:
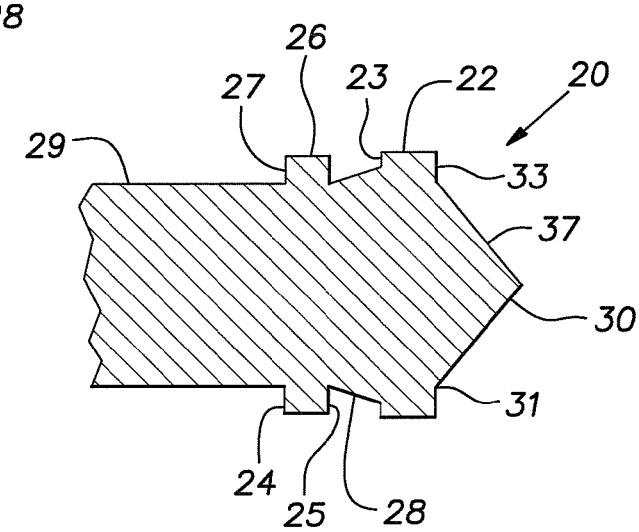

FIGS. 1, 2A and 2B show the present punch head arrangement 20. A first punch head 22 is provided having a first radial diameter, i.e. extending in a radial direction perpendicular to the axial direction. The first punch head 22 is formed on an operative end 24 of the punch body 12, i.e. on the opposite end from the chuck end 16 of the punch 10. A second punch head 26 is provided having a second radial diameter, i.e. also extending in a radial direction perpendicular to the axial direction. The second punch head 26 is substantially spaced from the first punch head 22 along the punch body 12 in the axial direction. A neck 28 is formed between the first and second punch heads 22, 26. The neck 28 has a tapered diameter less than the first and second radial diameters.

Punch 10 may be constructed of any one of a variety of metal materials, the exact material being determined by the composition of the workpiece that is being processed. However, for most applications wherein the workpiece comprises low carbon sheet steel, the punch is preferably formed of a carbon tool steel that is hardenable so as to provide carbide containing punch heads subsequent to the hardening of the steel.

By providing a double-headed punch with a uniform linearly tapered neck 28, it has been discovered that a cleaner, more efficient punch operation can be obtained. Metal is inherently somewhat elastic, and during a punch operation, the metal workpiece expands around the punch. In operation with the present punch 10, the first punch head 22 penetrates the metal. The workpiece expands around the first punch head 22 and contracts around the tapered neck 28. The workpiece subsequently encounters the second punch head 26, which performs a second punching operation. In this way, the first punch head 22 cuts the workpiece, and the second punch head 26 cleans the punched hole, thereby producing a clean hole that requires little or no subsequent machining, superior to the results obtained with a typical punch. The second punch head 26 also helps to ensure that proper tolerances are maintained on the hole that is being formed as the first punch head 22 wears. The tapered neck 28 serves to provide a location where oils and contaminants can accumulate instead of building up on the punch heads and distorting the dimensions of the hole being formed in the workpiece.

In the preferred embodiment, the first radial diameter associated with the first punch head 22 is greater than the second radial diameter associated with the second punch head 26. Preferably, the diameter of the second punch head 26 represents the desired final diameter of the punched hole. The first radial diameter is made larger to account for the inherent deformation of the metal. Also in the preferred embodiment, the tapered diameter of the neck 28 decreases uniformly from the first head 22 to the second head 26 providing a smooth continuous surface of decreasing diameter between first head 22 and second head 26. The tapered neck 28 extends so as to provide the following edge 23 of first head 22 and the leading edge 25 of second head 26 with surfaces that extend perpendicular to the tool axis 14. The taper along neck 28 allows the second head to "get a bite" on the workpiece, so as to result in a hole having the desired shape and size.

Preferably, the following edge 27 of second punch head 26 includes a surface that extends perpendicular to the tool axis 14. Also, preferably the outer diameter 29 of body 12 and following edge 27 meet to form substantially a right angle intersection 31.

The taper of the neck 28 is preferably angled with respect to the tool axis 14, and can vary with the material of the punch 10, since different materials have different mechanical strengths. For most common types of punch materials, it has been found that the tapered diameter of the neck 28 can be formed as a frusto-conical section with a pitch inclination of between 10-50 degrees. The leading edge 36 of neck 28 preferably has a diameter of between 60 and 100 percent of the diameter of the maximum diameter of the first punch head 22. Preferably, the following edge 39 of neck 28 has a diameter of between 50 and 95 percent of the maximum diameter of the second punch head 26.

The first punch head 22 preferably includes a pointed tip 30 for contacting and penetrating the workpiece. This pointed tip 30 is generally conical in shape. The base 31 of tip 30 has a diameter that is preferably between 60 and 100 percent of the diameter of the first punch head 22. Preferably, the sidewall 37 of tip 30 extends upwardly from the leading edge 33 of first punch head 22 at an angle of between 25-45 degrees.

It will be appreciated that punch 10 may be provided with additional punch heads. The present invention is not limited to a punch with two punch heads as shown above.

Figure 3A:
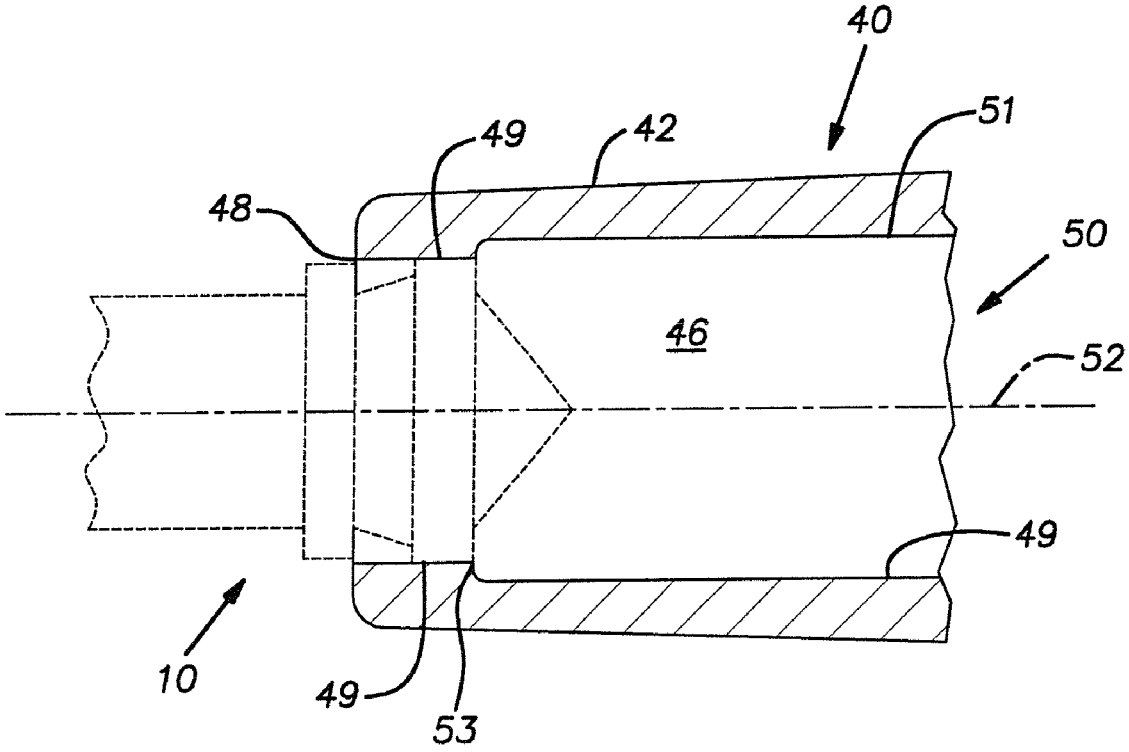
FIGS. 3A and 3B respectively show a side-sectional view of the die and a top view thereof, in accordance with the present invention.
Figure 3B:
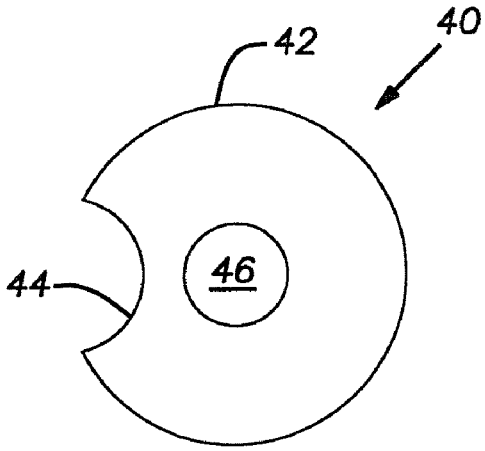

In another aspect of the invention, as shown in FIGS. 3A and 3B, the present punching tool includes a die 40 for cooperating with the punch 10 in creating a hole. The die 40 includes a die body 42 with a flute 44 for being received in a tool chuck in the punch press. The die body 42 includes a bore 46 with a first end 48 for receiving the punch 10. The die 40 cooperates with the punch 10 to remove a punched piece or "slug" from the workpiece. The bore 46 of die 40 has a second end 50 on an opposite side from the first end 48, and an intermediate end 53. The bore 46 is tapered in such a way that the second end 50 has a diameter greater than the diameter of the intermediate end 53. Thus, bore 46 is tapered with respect to a die axis 52, so that the bore 46 "flares out" from the first end 48 to the intermediate end 53. More particularly, preferably the inner wall 49 of die 40 extends at an angle of about 1-2 degrees relative to the die axis 52 so as to provide an opening of slightly increasing diameter. Also, as shown, preferably the bore 46 includes a cut-out portion 51 beginning at intermediate end 53 that further increases the diameter of the bore 46. Preferably, cut-out portion 51 has a diameter that is at least 5% greater than the diameter of the bore 46 at the first end 48. In this way, the punched piece of metal that is removed by a punch 10 cannot get hung up inside the bore 46 as can happen with a typical conventional die. Thus, the present bore 46 thereby facilitates the easy removal of the punched piece of metal from the die 40. It will be appreciated that die 40 may be used with punches of various configurations, such as conventional single head punches, and thus the use of die 40 is not limited to use with the punch 10 described above.

As described hereinabove, the present invention solves many problems associated with previous type devices. However, it will be appreciated that various changes in the details, materials and arrangements of parts which have been herein described and illustrated in order to explain the nature of the invention may be made by those skilled in the area within the principle and scope of the invention will be expressed in the appended claims.

We claim:

1. A tool for use with a punching press for punching holes in metal workpieces comprising:

a punch body, elongated in an axial direction;

a first punch head having a first radial diameter, perpendicular to the axial direction, wherein the first punch head is formed on an operative end of the punch body, said first punch head including a leading edge and a following edge each extending perpendicular to the axial direction of the punch body;

a conical pointed tip for contacting the workpiece, said tip located at the end of said first punch head, said tip having sidewalls that extend at an angle of between 25 ° and 45°;

a second punch head having a second radial diameter, perpendicular to the axial direction, wherein the second punch head is spaced from the first punch head and wherein the first radial diameter is greater than the second radial diameter, said second punch head including a leading edge and a following edge, each extending perpendicular to the axial direction of the punch body; and a neck formed between the first and second punch heads, such that said following edge of said first punch head and said lead edge of said second punch head form surfaces extending perpendicular to the axial direction of the punch body, said neck having a leading edge and a following edge and a uniformly linearly tapered diameter which is less than the first and second radial diameters of said first and said second punch heads, said neck comprising a frusto-conical section with a pitch inclination of between 10° and 50°, the following edge of the neck having a diameter between 50 and 95 percent of the second radial diameter of said second punch head;

wherein the tip, the first punch head, the neck and the second punch head are integral parts of a single whole.

* * * * *